US007377334B2

(12) United States Patent
May et al.

(10) Patent No.: US 7,377,334 B2
(45) Date of Patent: May 27, 2008

(54) ROTATING DRILLING HEAD DRIVE

(75) Inventors: James May, Houston, TX (US); Larry Moeller, Houston, TX (US); Jackson Debray, The Woodlands, TX (US); Joe W. Reeves, Corpus Christi, TX (US)

(73) Assignee: Smith International, Inc., Houston, TX (US)

( * ) Notice: Subject to any disclaimer, the term of this patent is extended or adjusted under 35 U.S.C. 154(b) by 281 days.

(21) Appl. No.: 11/010,989

(22) Filed: Dec. 13, 2004

(65) Prior Publication Data

US 2005/0133266 A1 Jun. 23, 2005

Related U.S. Application Data

(60) Provisional application No. 60/530,314, filed on Dec. 17, 2003.

(51) Int. Cl.
*E21B 3/02* (2006.01)
*E21B 19/24* (2006.01)

(52) U.S. Cl. ..... 175/57; 175/195; 166/78.1; 166/84.3

(58) Field of Classification Search ..... 175/57, 175/195; 166/78.1, 81.1, 84.3, 96.1
See application file for complete search history.

(56) References Cited

U.S. PATENT DOCUMENTS

| | | | | | |
|---|---|---|---|---|---|
| 2,333,847 | A | * | 11/1943 | Deely | 173/167 |
| 2,559,100 | A | * | 7/1951 | White | 464/166 |
| 2,731,281 | A | * | 1/1956 | Knox | 277/326 |
| 2,904,357 | A | * | 9/1959 | Knox | 277/328 |
| 4,304,310 | A | * | 12/1981 | Garrett | 175/195 |
| 5,647,444 | A | * | 7/1997 | Williams | 175/209 |

* cited by examiner

*Primary Examiner*—Kenneth Thompson
(74) *Attorney, Agent, or Firm*—Conley Rose, P.C.

(57) ABSTRACT

Methods and apparatus for rotating a stripper assembly in use with a rotating drilling head. A drive system is disposed external to the rotating drilling head and generates rotational motion to match the rotation of a drillstring running through the rotating drilling head. A connection transfers rotational motion from the drive system to the stripper assembly. In one embodiment, the drive system comprises a housing disposed about the drillstring and a one or more contact members connected to said housing and operable to contact the drillstring. One or more biasing members urge the contact members into contact with the drillstring so as to transfer rotational motion from the drillstring to the housing.

7 Claims, 7 Drawing Sheets

ROTATING DRILLING HEAD DRIVE

CROSS-REFERENCE TO RELATED APPLICATIONS

The present application claims the benefit of 35 U.S.C. 111(b) provisional application Ser. No. 60/530,314 filed Dec. 17, 2003, and entitled Rotating Drilling Head Drive.

STATEMENT REGARDING FEDERALLY SPONSORED RESEARCH OR DEVELOPMENT

Not Applicable.

FIELD OF THE INVENTION

The present invention relates generally to methods and apparatus for driving the rotating components of a rotating drilling head. More specifically the present invention relates to methods and apparatus for rotating the sealing element of a rotating drilling head in coordination with a rotating drilling string passing through the sealing element.

BACKGROUND

Rotating drilling heads employ elastomeric sealing elements to effectuate a seal between a rotating drillstring and the stationary head. The elastomeric sealing element is mounted on bearings that allow the sealing element to rotate with the drillstring. In most conventional drilling operations, the drilling head is positioned below the drill floor and above the blowout preventer. The drilling head operates to divert pressurized drilling fluids, and other materials flowing up through the wellbore, away from the drill floor.

In rotary drilling operations, the drillstring is rotated by a kelly drive or a top drive. A kelly drive engages a faceted member of the drill string, or kelly, that is connected to the drillstring. The kelly drive is often powered by a rotary table on the drill floor. Many rotating drilling heads are configured to be rotated by interfacing with the kelly either directly, or through a mechanical interface.

Top drive drilling systems rotate the drillstring using an electric or hydraulic motor mounted directly to the top of the drillstring. In top drive drilling systems no kelly is used and the rotating drilling head has to rely on the friction contact between the sealing element and the drillstring to rotate the sealing element. This friction contact is often insufficient to cause sufficient rotation of the sealing element, resulting in relative rotary motion between the drill pipe and the sealing element. A relative rotary motion between the sealing element and the drill pipe can lead to excessive wear in the sealing element, thus reducing the effective life of the seal.

Accordingly, there remains a need to develop methods and apparatus for rotating the sealing element of a rotating drilling head that overcome certain of the foregoing difficulties while providing more advantageous overall results.

SUMMARY OF THE PREFERRED EMBODIMENTS

The embodiments of the present invention are directed to methods and apparatus for rotating a stripper assembly in use with a rotating drilling head. The preferred drive systems seek to synchronize the rotation of the rotating head sealing element with the rotation of the drillstring passing through the sealing element in order to reduce wear on the sealing element. A drive system is disposed external to the rotating drilling head and generates rotational motion to match the rotation of a drillstring running through the rotating drilling head. A connection transfers rotational motion from the drive system to the stripper assembly. In one embodiment, the drive system comprises a housing disposed about the drillstring and a one or more contact members connected to said housing and operable to contact the drillstring. One or more biasing members urge the contact members into contact with the drillstring so as to transfer rotational motion from the drillstring to the housing.

In one embodiment, a drive system comprises a housing containing roller assemblies that contact the drillstring. The housing is coupled to the sealing element of a rotating drilling head such that the sealing element rotates with the housing. The roller assemblies are urged into contact with the drillstring by a biasing member that maintains a contact force on the drillstring but allows tool joints and other increased diameter objects to pass through the roller assemblies. The contact force on the drillstring creates a friction force that causes the roller assemblies and housing to rotate with the drillstring, thus driving the sealing element of the drilling head.

In another embodiment, a drive system comprises a casing surrounding the drillstring and linking the sealing element of a rotating drilling head to the rotary table on the drill floor. The rotary table is rotated in unison with the drillstring such that the casing rotates the sealing element in unison with the drillstring. In certain embodiments, the casing has an upper and lower section that are rotationally coupled but are allowed to translate axially relative to each other, thus allowing for variation in the distance between the rotary table and the drilling head.

In another embodiment, a drive system comprises a rotating motor adapted to directly rotate the sealing element of a rotating drilling head. In one embodiment, a gear is coupled to the sealing element and engaged with a pinion powered by a hydraulic or electric motor. A control system operates the motor so as to rotate the sealing element in unison with the drillstring.

Thus, the present invention comprises a combination of features and advantages that enable it to overcome various shortcomings of prior devices. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENTS

Figure 1:
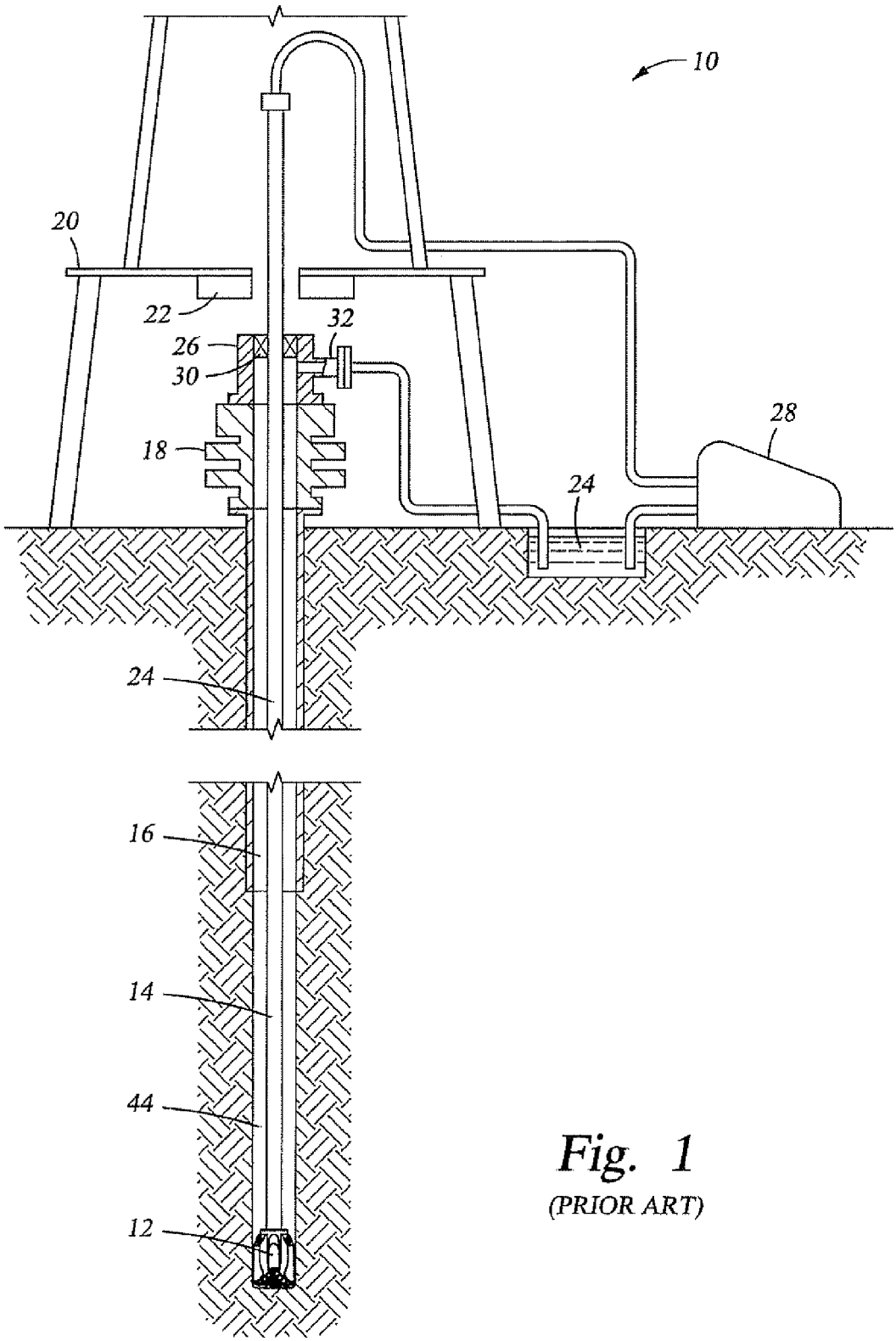
Fig. 1 (PRIOR ART)
FIG. 1 illustrates an exemplary drilling rig arrangement.

In the description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results.

In particular, various embodiments described herein thus comprise a combination of features and advantages that overcome some of the deficiencies or shortcomings of prior art rotating drilling head systems. The various characteristics mentioned above, as well as other features and characteristics described in more detail below, will be readily apparent to those skilled in the art upon reading the following detailed description of preferred embodiments, and by referring to the accompanying drawings.

Referring now to FIG. 1, there is shown a conventional rig 10 for rotating a drill bit 12 on the end of a drillstring 14 for drilling a well bore 16. The drillstring 14 extends through a blowout preventer ("BOP") stack 18 located beneath the rig floor 20 and includes a plurality of drill pipes 14 extending to the drill bit 12. The drillstring 14 transmits rotational and axial movements to the drill bit 12 for drilling the well bore 16. The drilling rig 10 includes a rotary table 22 connected to the floor 20 of rig 10. Torque is transmitted to drillstring 14 by rotary table 22 or a top drive system suspended in the rig 10.

Drilling fluids, often referred to as drilling mud, are pumped downward through drillstring 14 under high pressure, through drill bit 12 and then return upwardly via the annulus 44 formed between well bore 16 and drillstring 14. The returning drilling fluid is diverted beneath the rig floor 20 to a mud reservoir 24 by means of a device commonly referred to in the industry as a rotating drilling head assembly 26. Pump 28 draws drilling fluid from reservoir 24 and pumps it back into drillstring 14.

A rotating drilling head assembly 26 is typically mounted below the floor 20 of the drilling rig 10 on the top of the BOP stack 18 to redirect the drilling fluid returning from the well bore 16 and to allow rotation and deployment of the drillstring 14 through the rotary table 22. Rotating drilling head 26 includes a sealing element 30 that seals the annulus between drillstring 14 and the drilling head. Thus, drilling fluid is forced out through outlet 32 into reservoir 24. During normal drilling operations, the blowout preventers are maintained in the "open" position, leaving only rotating drilling head 26 to contain any pressure within wellbore 16 and divert the returning pressurized drilling fluids away from the rig 10.

Figure 2:
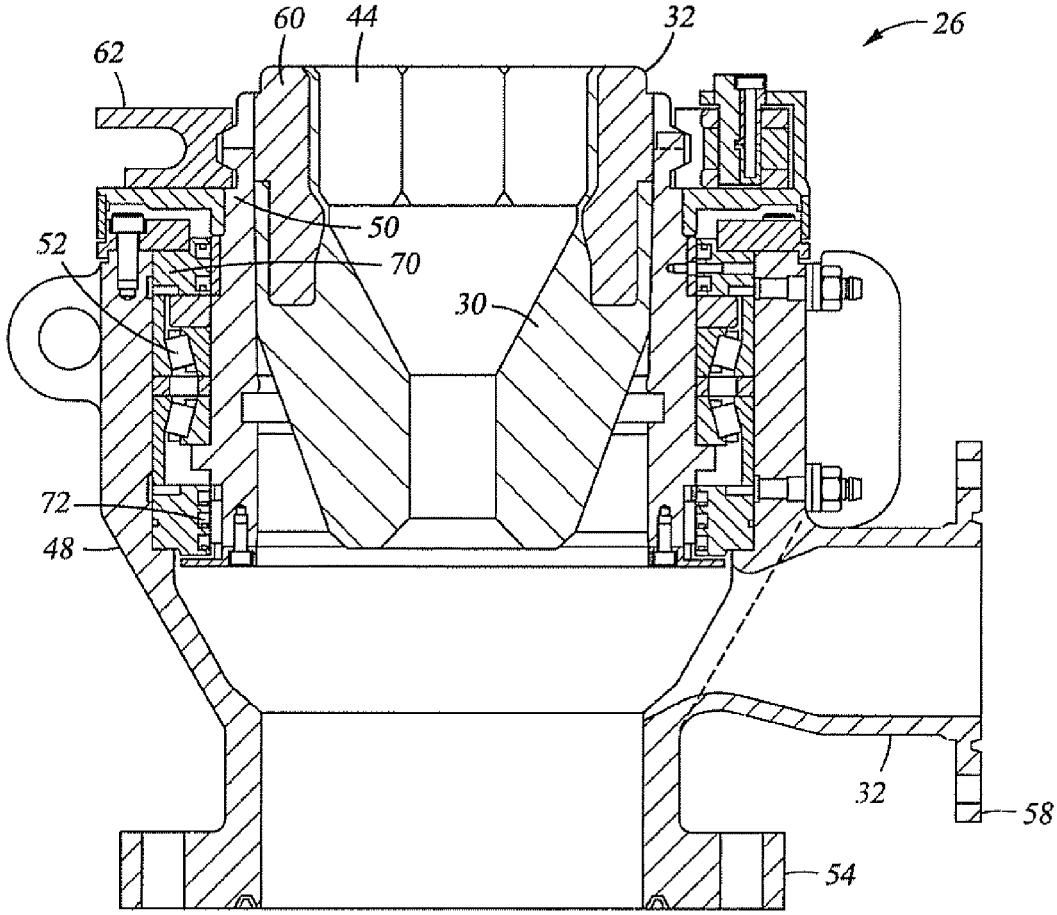
Fig. 2 (PRIOR ART)
FIG. 2 illustrates an exemplary rotating drilling head.

FIG. 2 illustrates a typical prior art rotating drilling head assembly 26 having an outer stationary housing or bowl 48 and an inner drive ring 50 with a bearing assembly 52 disposed in between allowing drive ring 50 to rotate within bowl 48. Outer bowl 48 includes a flange 54 for mounting the assembly 26 to the BOP stack and a flow diverter port or outlet 32 having a flange 58 for the attachment of a pipe extending to the mud reservoir. Assembly 26 further includes stripper assembly 60, which is slidably received within drive ring 50 and connected to the upper end of drive ring 50 by a retaining clamp 62 allowing stripper assembly 60 to rotate with inner drive ring 50.

Stripper assembly 60 includes sealing element, or stripper rubber, 30 bonded to inner drive bushing 34. Inner drive bushing 34 has a faceted profile 44 that can be engaged to impart torque onto stripper assembly 60. Non-rotary seals 70 and 72, respectively, serve to isolate bearing assembly 52 from drilling fluids and to keep lubricating fluid from escaping the bearing assembly. Sealing engagement between sealing element 30 and drillstring 14 is effectuated by the sealing element being stretched to fit around the drillstring.

Figure 4:
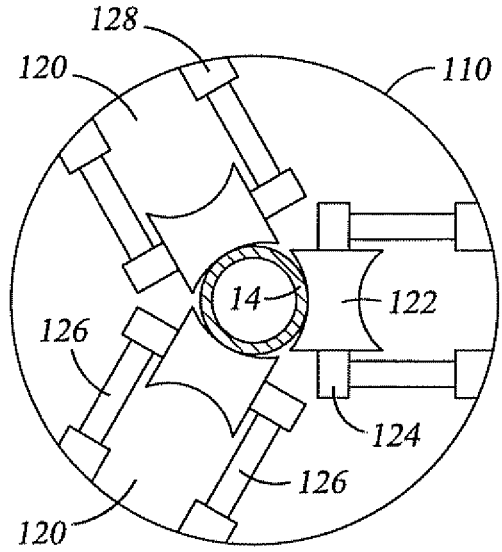
FIG. 4 illustrates a partial sectional plan view of the drive system of FIG. 3.
Figure 3:
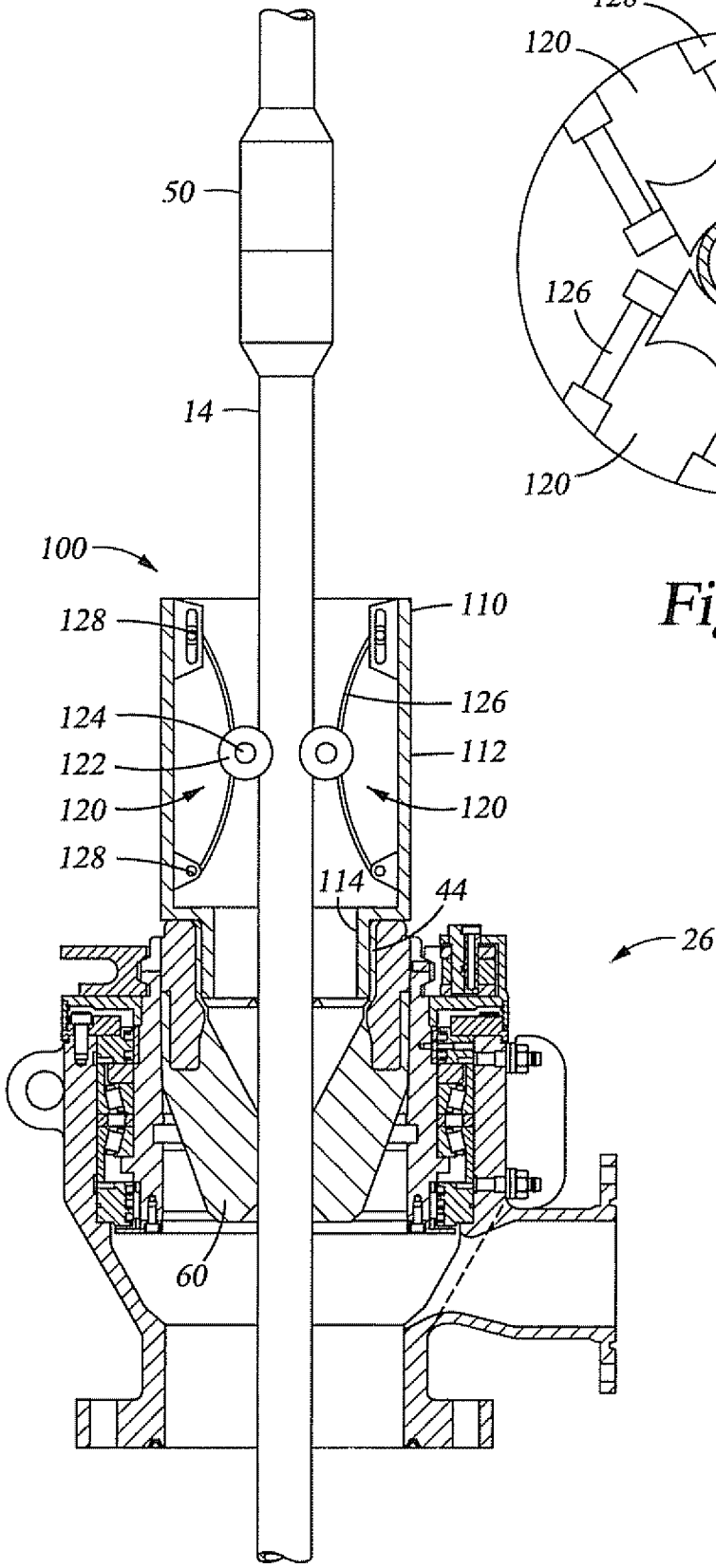
FIG. 3 illustrates a partial sectional elevation view of one embodiment of a rotating drilling head drive system.

Referring now to FIGS. 3 and 4 a rotating drilling head drive system 100 is shown engaged with drillstring 14 and rotating drilling head assembly 26. Drive system 100 comprises housing 110 and roller assemblies 120. Housing 110 includes an upper portion 112 containing roller assemblies 120 and a lower portion 114 having a faceted outer surface adapted to engage faceted surface 44 of stripper assembly 60. Each roller assembly 120 includes roller 122, shaft 124, biasing members 126, and base 128.

Roller 122 engages drillstring 14 and is rotatably mounted to shaft 124. Shaft 124 is supported by biasing members 126, which push roller 122 against drillstring 14. Biasing members 126 are affixed to housing 110 by base 128. Rollers 122 are preferably constructed from a material having a surface that will provide sufficient contact with drillstring 14 without damaging the drillstring. For example, roller 122 may be constructed from a steel core covered with a resilient coating.

Rollers 122 are urged against drillstring 14 by biasing members 126. Biasing members 126 act to apply sufficient force to maintain the contact of rollers 122 on drillstring 14 but also allow increased diameter portions of the drillstring, such as tool joint 50, to pass through the rollers. Biasing members 126 are supported by base 128, which is attached to housing 110. Biasing members 126 may be coil springs, leaf springs, hydraulic springs, or any other type of biasing system that support rollers 122.

Drillstring 14 is moved axially while being rotated about its longitudinal axis. Rollers 122 allow for axial translation of drillstring 14. Rollers 122 grip drillstring 14 so that the rotation of the drillstring imparts a torque on housing 110 that is transferred through faceted members 114 and 44 into stripper assembly 60. Thus, stripper assembly 60 will rotate with substantially the same rate of rotation as drillstring 14, reducing wear on the stripper assembly.

Drive system 100 is shown having three rollers 122 but any number of rollers may be used to achieve sufficient transfer of torque to the drive system from drillstring 14. In the preferred embodiments, the surface area of the engagement between drive system 100 and drillstring 14 is maximized in order to minimize the contact stress, or pressure, on the drillstring. Non-rolling contact members could also be used as an alternative to rollers 122, as long as wear to drillstring 14 is minimized.

Drive system 100 is shown as an additional component that interfaces with stripper assembly 26 but it could also be integrated into the stripper assembly. In certain embodiments, drive system 100 may be locked, or otherwise releasably latched, to stripper assembly 26 to maintain the position of the drive system during back-reaming or to provide positive engagement during installation and removal of the drive system. As an alternative to engaging stripper assembly 26, drive system 100 may also be constructed to directly engage the rotating section of bearing assembly 52.

Figure 5:
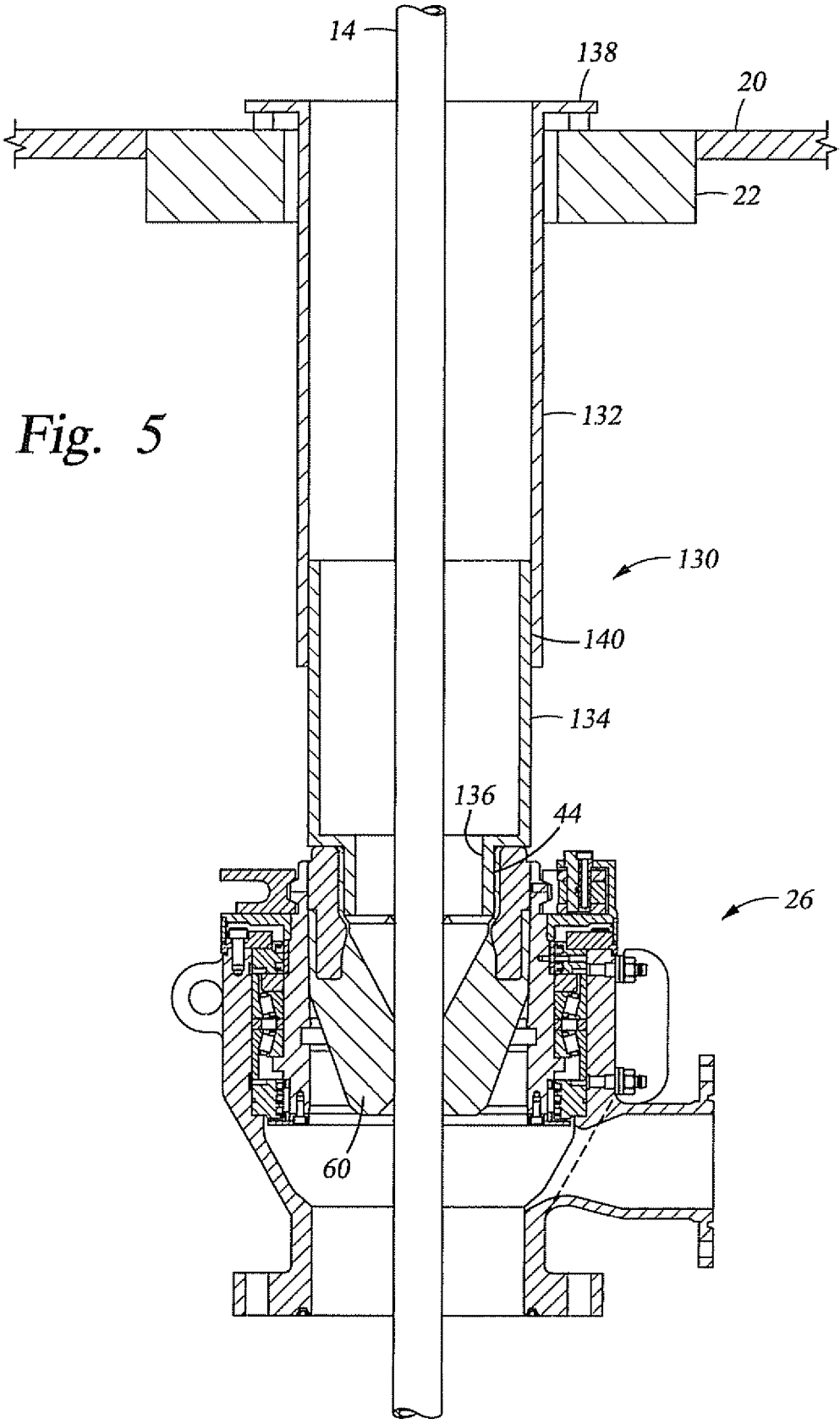
FIG. 5 illustrates a partial sectional elevation view of an alternate embodiment of a rotating drilling head drive system.

Referring now to FIG. 5, an alternative drive system 130 is shown connecting drilling head 26 to rotary table 22. Drive system 130 includes an upper casing 132 and a lower casing 134 joined at connection 140. Upper casing 132 has upper end 138 coupled to rotary table 22 so that the rotary table can be used to rotate the upper casing. Connection 140 transfers torque from upper casing 132 to lower casing 134. Connection 140 preferably allows axial translation between casings 132 and 134 so as to allow for height variations between drill floor 20 and drilling head 26. Lower casing 134 has a faceted lower end 136 adapted to interface with faceted profile 44 of stripper assembly 60.

Therefore, the rotation generated by rotary table 22 is transferred through upper casing 132 and lower casing 134 into stripper assembly 60. Because the relative rotary slippage between stripper assembly 60 and drillstring 14 is reduced, the service life of the stripper assembly is increased. In the preferred embodiments, rotary table 22 is synchronized with the rotation of drillstring 14 so as to closely match the rotation of the drillstring and stripper assembly 60. In top drive drilling systems, this synchronization is likely carried out by a control system regulating the rotational speed of the top drive and the rotary table.

Figure 6:
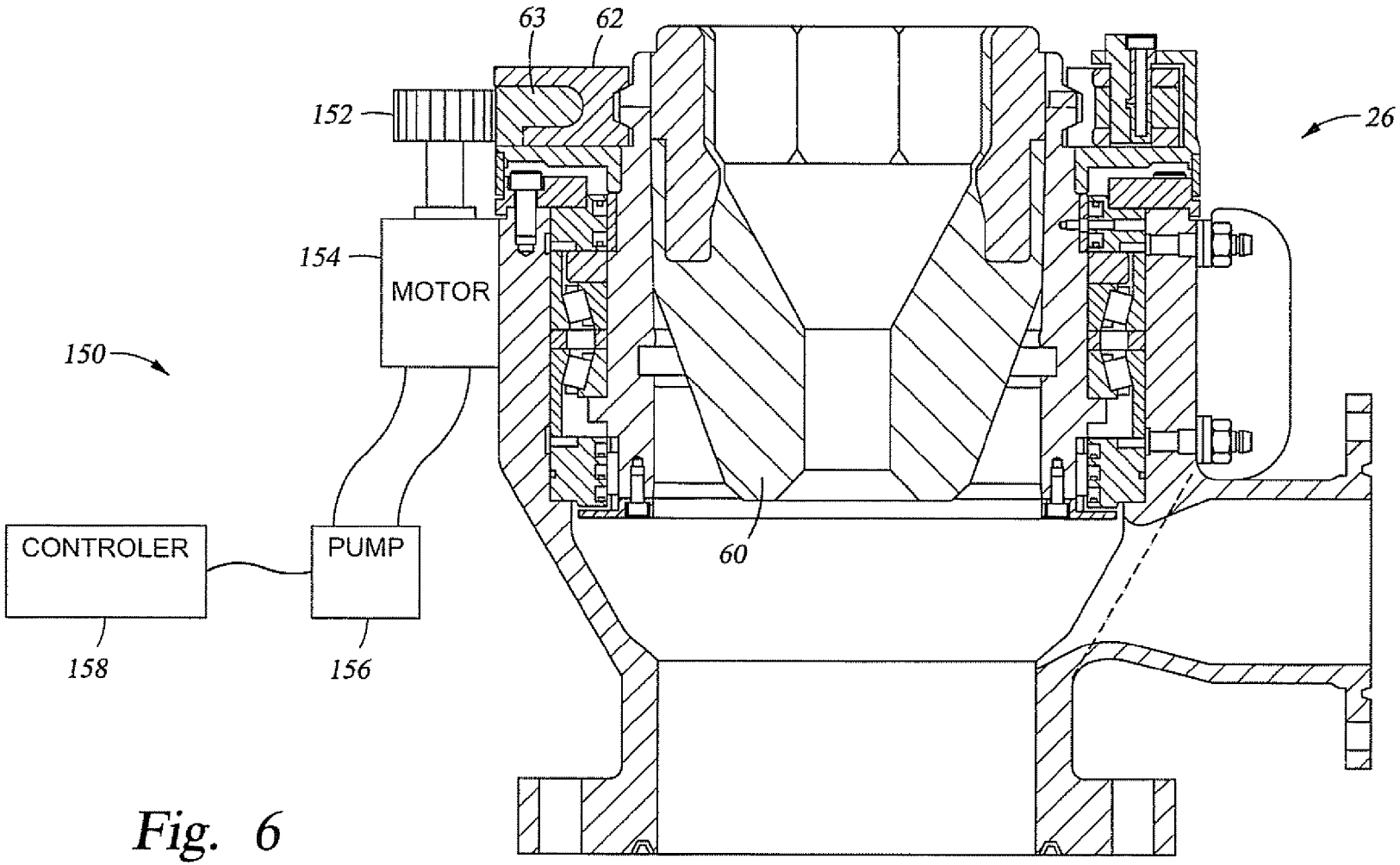
FIG. 6 illustrates a partial schematic view of an alternate embodiment of a rotating drilling head drive system.

Referring now to FIG. 6 a second alternative drive system 150 is shown. Drive system 150 includes a drive pinion 152 that engages corresponding gear 63 attached to flange 62. Flange 62 is connected to the rotating portion of head 26 such that stripper assembly 60 rotates with the flange. Drive pinion 152 is rotated by hydraulic motor 154, which is powered by pump 156 and controlled by controller 158. In alternate embodiments, an electric, pneumatic, or other motor may replace hydraulic motor 154.

The speed of motor 154 is controlled so as to rotate stripper assembly 60 at the same rotational speed of a drillstring passing through the stripper assembly, which reduces wear on the stripper assembly. Thus, in the preferred embodiments controller 158 is linked to the drilling control system so as to match the rotational speed of stripper assembly 60 to the rotational speed of a top drive or kelly drive.

Figure 8:
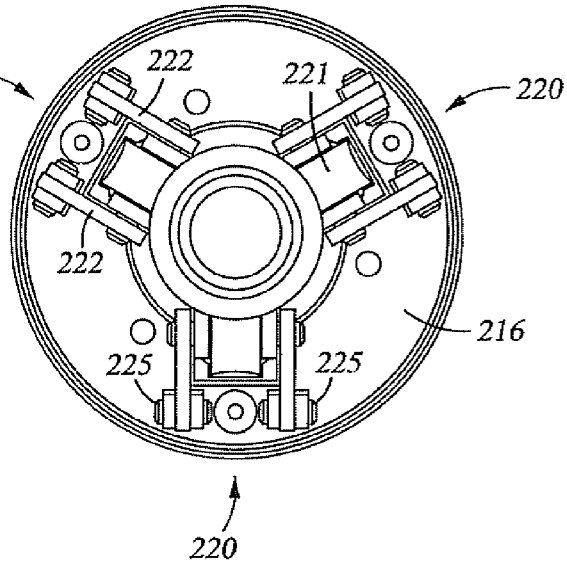
FIG. 8 illustrates a partial sectional plan view of the system of FIG. 7.
Figure 7:
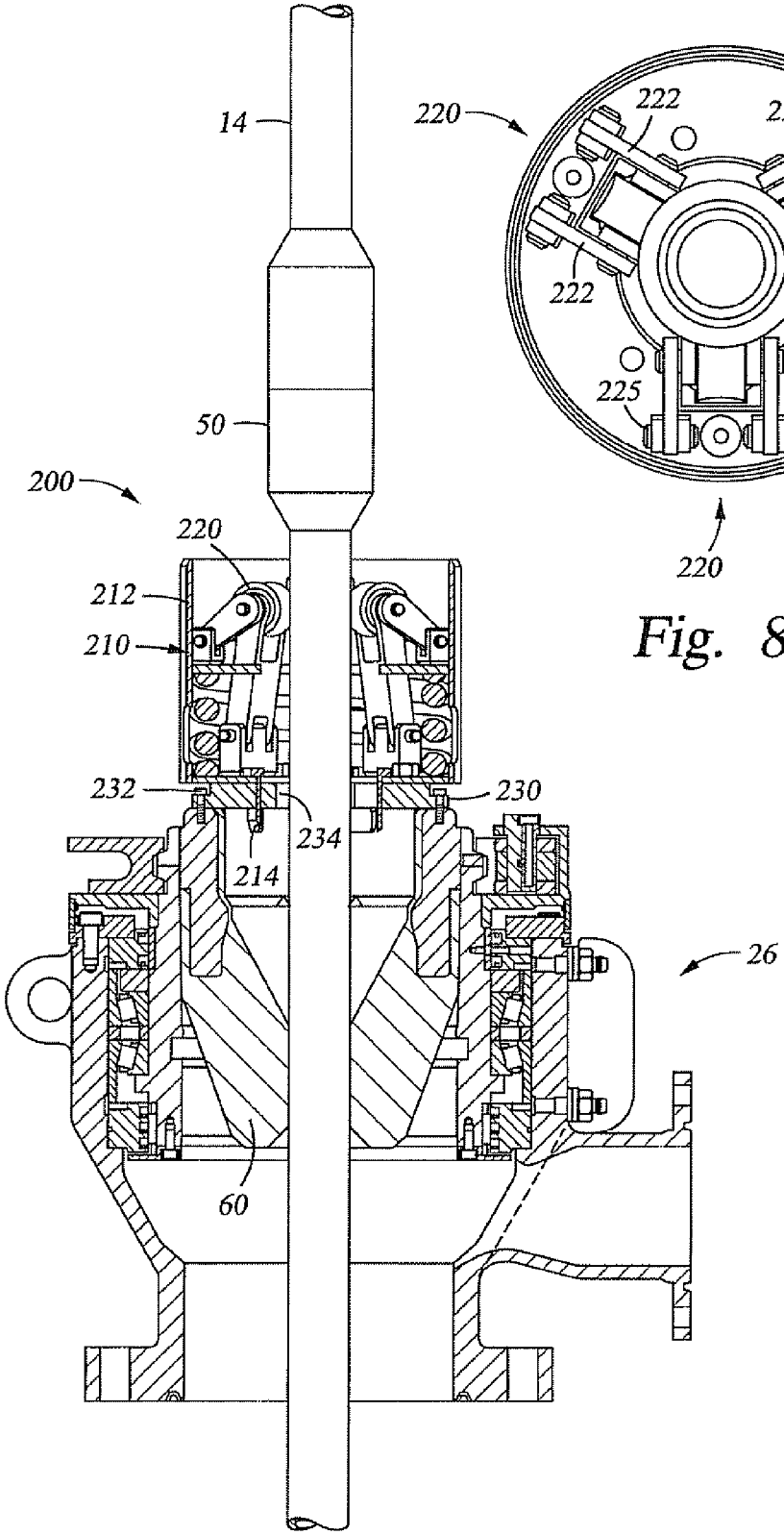
FIG. 7 illustrates a partial sectional elevation view of one embodiment of a rotating drilling head drive system.
Figure 9:
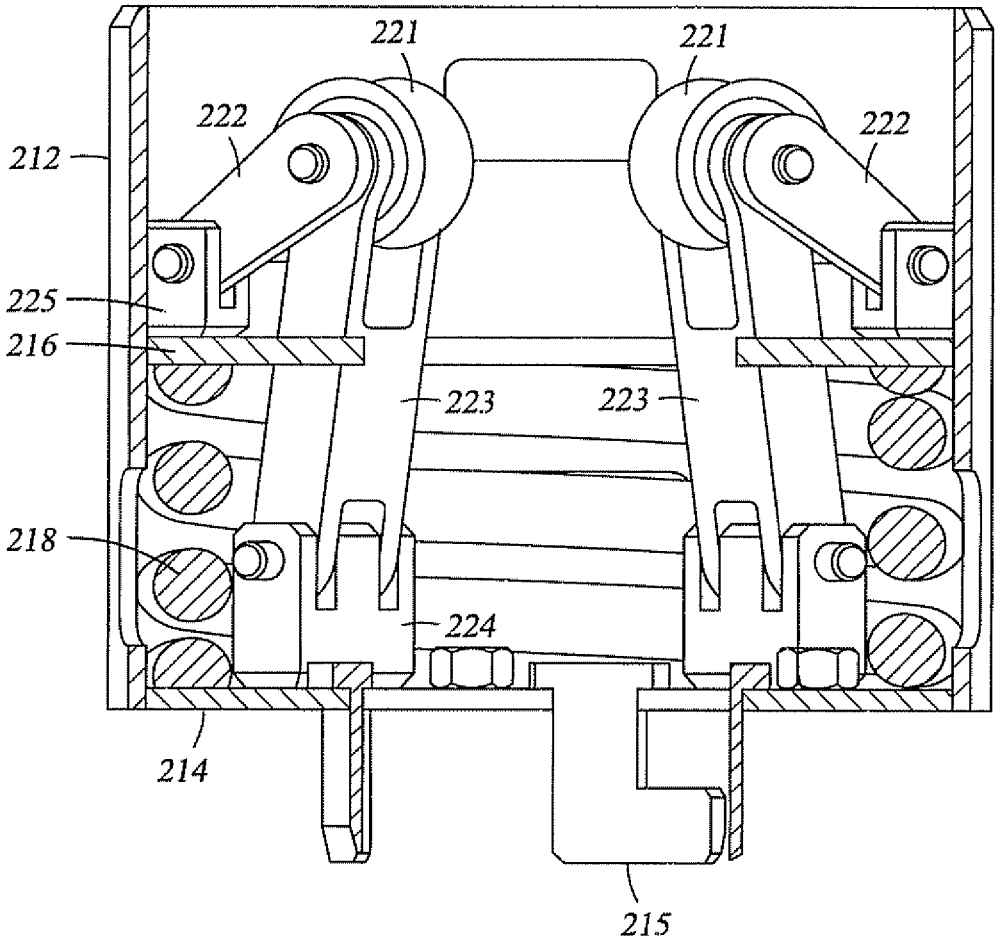
FIG. 9 illustrates a partial sectional elevation view of the drive system of FIG. 7.

Referring now to FIGS. 7-9, a rotating drilling head drive system 200 is shown engaged with drillstring 14 and rotating drilling head assembly 26. Drive system 200 comprises housing 210, roller assemblies 220, and adapter plate 230. Housing 210 comprises an upper portion 212 containing roller assemblies 220 and drive lugs 215 that connect housing 210 to adapter plate 230. Adapter plate 230 is connected to stripper assembly 60 via bolts 232 or some other rigid connection. Roller assemblies 220 engage drillstring 14 and transfer torque from the drillstring through adapter plate 230 to stripper assembly 60.

As can be seen in FIG. 9, each roller assembly 220 includes roller 221, upper link 222, and lower link 223. Lower links 223 are pivotally connected to housing base plate 214 by individual lower anchor blocks 224. Upper links 222 are pivotally connected to follower plate 216 by individual upper anchor blocks 225. Biasing member 218 is disposed between follower plate 216 and housing base plate 214 so as to urge the follower plate upward. Biasing member 218 may be one or more coil springs, a hydraulic spring system, or any other system for urging follower plate 216 upward.

The upward movement of follower plate 216 and upper anchor blocks 225 moves rollers 221 inward toward the center of housing 210 and drillstring 14. Rollers 221 allow drillstring 14 to move axially while being rotated about its longitudinal axis. Biasing member 218 applies sufficient force to maintain the contact of rollers 221 on drillstring 14 but also allow increased diameter portions of the drillstring, such as tool joint 50, to pass through the rollers.

Rollers 221 are preferably constructed from a material having a surface that will provide sufficient contact with drillstring 14 without damaging the drillstring. For example, rollers 221 may be constructed from steel cores having a concave outer surface covered with a resilient coating. Drive system 200 is shown having three rollers 221 but any number of rollers may be used to achieve sufficient transfer of torque to the drive system from drillstring 14. In the preferred embodiments, the surface area of the engagement between drive system 200 and drillstring 14 is maximized in order to minimize the contact stress, or pressure, on the drillstring.

To install drive system 200, follower plate 216 is pushed downward, compressing biasing member 218 and moving rollers 221 outward. Follower plate 216 may be maintained in the lowered position by a retainer pin (not shown) or other member that fixes the position of the follower plate relative to housing 210. Once drillstring 14 is disposed within drive system 200, the retainer pin is released and biasing member 218 urges follower plate 216 upward, moving rollers 221 inward until they contact the drillstring.

Drive lugs 215 are L-shaped members that engage slots 234 on adapter plate 230. As housing 210 is rotated clockwise by the rotation of drillstring 14, the horizontal portion of drive lugs 215 prevent vertical disengagement of the lugs and adapter plate 230. Therefore, system 200 will rotate stripper assembly 60 whether drillstring 14 is being moved downward, such as in normal drilling, or upward, such as during backreaming. Lugs 215 can be disengaged from slots 234 by rotating drillstring 14, and therefore housing 210, counterclockwise and upward.

While preferred embodiments of this invention have been shown and described, modifications thereof can be made by one skilled in the art without departing from the scope or teaching of this invention. The embodiments described herein are exemplary only and are not limiting. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims.

What is claimed is:

1. An assembly for use with a rotating drilling head, the assembly comprising:

a drive system disposed external to the rotating drilling head, wherein said drive system generates rotational motion to match the rotation of a drillstring running through the rotating drilling head; and a connection operable to transfer rotational motion from said drive system to a stripper assembly disposed within the rotating drilling head, wherein said drive system comprises:

a housing disposed about the drillstring;

a one or more contact members connected to said housing and operable to contact the drillstring; and one or more biasing members operable to urge said contact members into contact with the drillstring so as to transfer rotational motion from the drillstring to said housing.

2. The assembly of claim 1 wherein said contact members further comprise rollers having a concave outer surface that engages the drillstring.

3. The assembly of claim 1 wherein at least one of said biasing members further comprises a leaf spring disposed between one of said contact members and said housing.

4. The assembly of claim 1 further comprising:

a follower plate moveably disposed within said housing;

a housing base plate attached to said housing;

a linkage connecting said follower plate to said housing plate, wherein said linkage supports one of said contact members; and wherein said biasing member is a spring disposed between said follower plate and said base plate.

5. The assembly of claim 1, wherein said connection comprises:

an adapter plate attached to the stripper assembly;

a plurality of slots through said adapter plate; and a plurality of lugs connected to said housing, wherein said lugs are arranged so as to engage said plurality of slots on said adapter plate.

6. The assembly of claim 5 wherein said lugs and slots are arranged so as connect said housing to the stripper assembly as said housing is rotated in a first direction and to allow said housing to be removed from the stripper assembly when said housing is rotated in the opposite direction.

7. A rotating drilling head drive method comprising:

engaging a stripper assembly with a rotating assembly, wherein the stripper assembly is rotatably disposed within the rotating drilling head;

activating the rotating assembly so as to rotate the stripper assembly in synchronization with a drillstring disposed within the stripper assembly, wherein the rotating assembly is activated by engaging a drillstring extending through the rotating drilling head with one or more contact members connected to a housing disposed about the drillstring; and biasing the contact members against the drillstring so as to transfer rotational motion from the drillstring to the housing.

* * * * *